US006305140B1

(12) United States Patent
Knight

(10) Patent No.: US 6,305,140 B1
(45) Date of Patent: Oct. 23, 2001

(54) POLE

(76) Inventor: Lenard Knight, 2671 Delaware Rd., Deltona, FL (US) 32738

( * ) Notice: Subject to any disclaimer, the term of this patent is extended or adjusted under 35 U.S.C. 154(b) by 0 days.

(21) Appl. No.: 09/641,942

(22) Filed: Aug. 21, 2000

Related U.S. Application Data

(60) Provisional application No. 60/152,554, filed on Sep. 7, 1999.

(51) Int. Cl.[7] ..... E04C 3/30

(52) U.S. Cl. ..... 52/736.1; 52/736.2; 52/736.3; 52/726.4; 52/723.1

(58) Field of Search ..... 52/736.1, 736.3, 52/738.1, 153, 721.4, 723.1, 724.5, 726.4, 730.4, 732.1, 736.2

(56) References Cited

U.S. PATENT DOCUMENTS

| | | | | |
|---|---|---|---|---|
| 3,141,655 | | 7/1964 | Platt . | |
| 3,181,849 | | 5/1965 | Mitchell . | |
| 4,244,156 | | 1/1981 | Watts, Jr. . | |
| 5,503,371 | | 4/1996 | Bies . | |
| 5,704,188 | * | 1/1998 | Coulis | 52/736.3 |
| 5,809,734 | * | 9/1998 | Turner | 52/736.1 |
| 6,123,485 | * | 9/2000 | Mirmiran et al. | 405/252 |
| 6,167,673 | * | 1/2001 | Fournier | 52/726.4 |

* cited by examiner

*Primary Examiner*—Carl D. Friedman
*Assistant Examiner*—Jennifer I. Thissell
(74) *Attorney, Agent, or Firm*—Patent & Trademak Services; Thomas Zack; Joseph H. McGlynn

(57) ABSTRACT

A pole assembly that has an inner pole fitted within an outer pole. The outer pole has a larger cross section dimension that the inner pole with a space between the two poles. Sets of two lateral supporting members extend from and joined to inner pole to the outer pole. Each set of lateral supports has two cross members both of which engage the inner pole and the outer pole. The space between the poles can be filled with a deposited fill material, like water or sand, that is impact absorbing to reduce injury and damage to a driver, a colliding vehicle and the post assembly. Each of the sets of lateral supporting members has two cross members that are perpendicular to each other and joined to each of the poles. Depending on the particular use for the pole, like a utility pole, wires or cables may extend up the height of the poles in the space between them by entering through holes in the lateral supports. These lateral supporting members may each be made of solid material, hollow material or any combination of solid and hollow material. An impact absorbing material like PVC plastic may be used to construct the poles and the lateral supports. To increase stability the outer pole may be tapered from bottom to top with closing end caps to retain any fill material.

2 Claims, 1 Drawing Sheet

POLE

This invention claims the benefit of the U.S. Provisional application 60/152,554 filed on Sep. 7, 1999.

BACKGROUND OF THE INVENTION

The present invention relates to a pole assembly that can be used as a lamp post, fence pole, utility pole or the like.

Many different types of poles or posts are known in the prior art. For example, one such earlier pole assembly was made from a material designed to absorb impacts. In another earlier invention related invention, a shock absorbing guard is placed around a basketball goal post.

Another prior art invention discloses a tubular plastic shell with an overlapping longitudinal seam which allows the shell to be placed around a vertical pole.

Still another patent discloses a cuff which is placed around objects to prevent damage from lawn equipment.

DESCRIPTION OF THE PRIOR ART

Pole assembly or post assemblies, the terms pole(s) or post(s) are used interchangeability herein, have been disclosed in a great variety of different designs and configurations. Some have been designed for specific purposes. For example, U.S. Pat. No. 3,141,655 to Platt which was made from material to absorb impacts.

U.S. Pat. No. 3,181,849 to Mitchell discloses a shock absorbing guard that is placed around a basketball goal post.

U.S. Pat. No. 4,244,156 to Wafts, Jr. discloses a tubular plastic shell with an overlapping longitudinal seam which allows the shell to be placed around a vertical pole.

U.S. Pat. No. 5,503,371 to Bies discloses a cuff which is placed around objects to prevent damage from lawn equipment.

In the present invention a pole is constructed with an inner tube and an outer tube with cross hatched support tubes connecting the inner and outer tubes all as will be detailed in the specification that follows hereafter.

SUMMARY OF THE INVENTION

This invention relates to a pole having an inner and an outer pole which are interconnected by support tubes.

It is the primary object of the present invention to provide for an improved pole that is durable, strong and easier to repair than existing poles when subjected to destructive forces.

Another object is to provide for such a pole wherein when used for a utility pole, drivers who impact them would be subject to decreased injuries by reducing the impact shock.

A further object is to provide for such a pole which when used as a utility pole would permit wires or other utility lines to extend through the interior of the pole to be protected from the elements.

These and other objects and advantages of the present invention will become apparent to readers from a consideration of the ensuing description and the accompanying drawings.

DESCRIPTION OF THE PREFERRED EMBODIMENT

Figure 1:
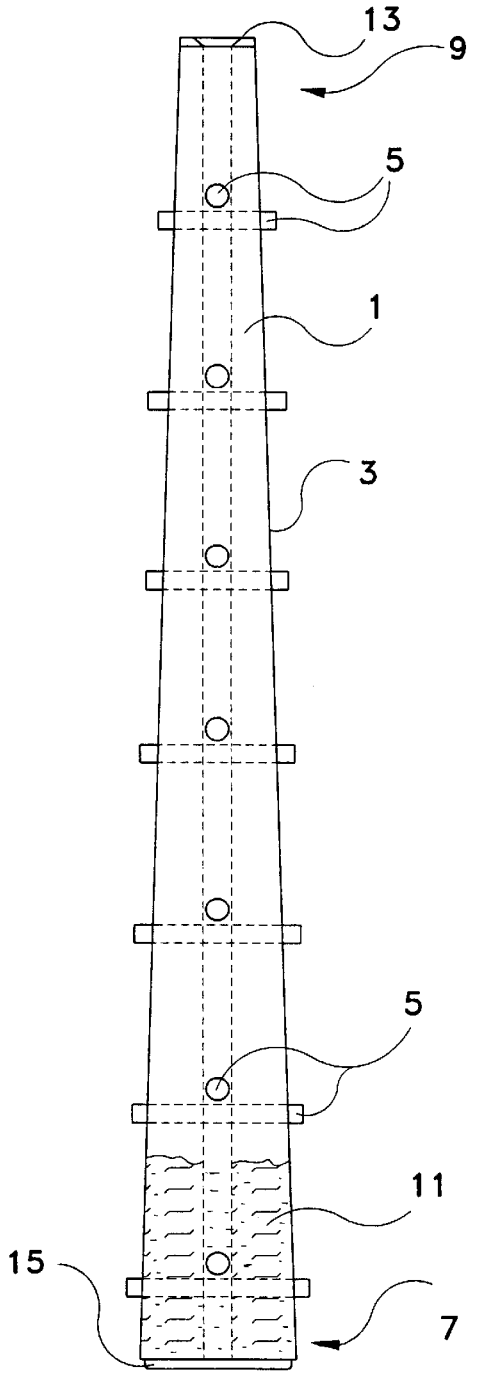
FIG. 1 is a side view of the present invention showing the inner and outer poles with their supporting tube members.

FIG. 1 is a side view of the present invention showing the inner pole 1, in dotted line format, and the outer pole 3 with their supporting tube members 5. The poles or posts 1 and 3 are generally concentric with each other with a hollow space between them along their heights. Typically the smaller inner pole 1 has a diameter of about ⅓ that of the larger outer pole 3 with the outer pole extending around and along the height of the inner pole. To provide greater stability, the outer pole 3 may be slightly tapered from its pole bottom 7 to the pole top 9.

The lateral supporting cross tubular members 5 consists of a series of horizontally spaced cylinder sets with each set having two generally perpendicular members that intersect both poles 1 and 3. The two cross supporting members 5 of each set would normally not intersect each other or touch each other. These sets of supports provide increased lateral stability for the upright poles I and 3 and act to join them together in a somewhat rigid configuration. An impact resistant plastic material, like PVC (polyvinyl chloride), may be used to construct the poles and the sets of supporting members 5, seven of which are shown.

Depending on the particular use of the poles 1 and 3, the supporting members 5 may be either all solid material, hollow tubular members or a mixture of the solid and hollow tubular members. If wires or another conduits are to be run up into the interior between the poles then at least on of the lower supports 5 could be a hollow tube with an interior opening to permit the wires or cables to extend into the interior between the poles 1 and 3. An approximate wire exit opening would be provided near the top of the pole 3 to allow lighting fixtures or other electrically operated equipment to be mounted on the pole and operated.

Between the inner pole 1 and the outer pole 3 is a hollow space or volume. Fill material (shown as dotted lines 11 near the bottom 7 of the two poles) such as water, gravel, concrete or sand may be used to partially or totally fill this void between the poles. This added material should at least be initially flow able and acts to add weight and stability to the upright poles. Depending on which material is selected, the material may also provide for a degree of impact absorbing material. For example, if flow able sand or water were selected for the fill material, then an impact to the outer pole would be distributed throughout to this movable impact absorbing fill material to decrease the resulting reactive force transmitted to the driver, vehicle and inner pole 1.

Should wires or other cables be inserted into the space between the poles, like in a utility or light pole, any fill material selected should be electrically non conductive to avoid the possibility of an electrical discharge should there be a crack or break in the enclosed wire or cable. To fill the interior between the poles 1 and 3 a top or upper cap 13 would be removed allowing the user to gravity fed material which would then settle to engage the bottom or lower cap 15 surface.

Figure 2:
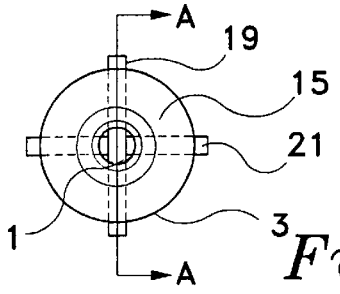
FIG. 2 is a top view of the invention shown in FIG. 1.

FIG. 2 is a top view of the invention shown in FIG. 1 with the upper cap 13 removed. The supporting member sets 5 each have two perpendicular supporting members 21 and 19 with each member of each set being vertically aligned with a member of another set. Below the lowest set is the lower cap 15 fitted to extend completely across the bottom surfaces of the two poles 1 and 3 and close their opened bottoms.

Figure 3:
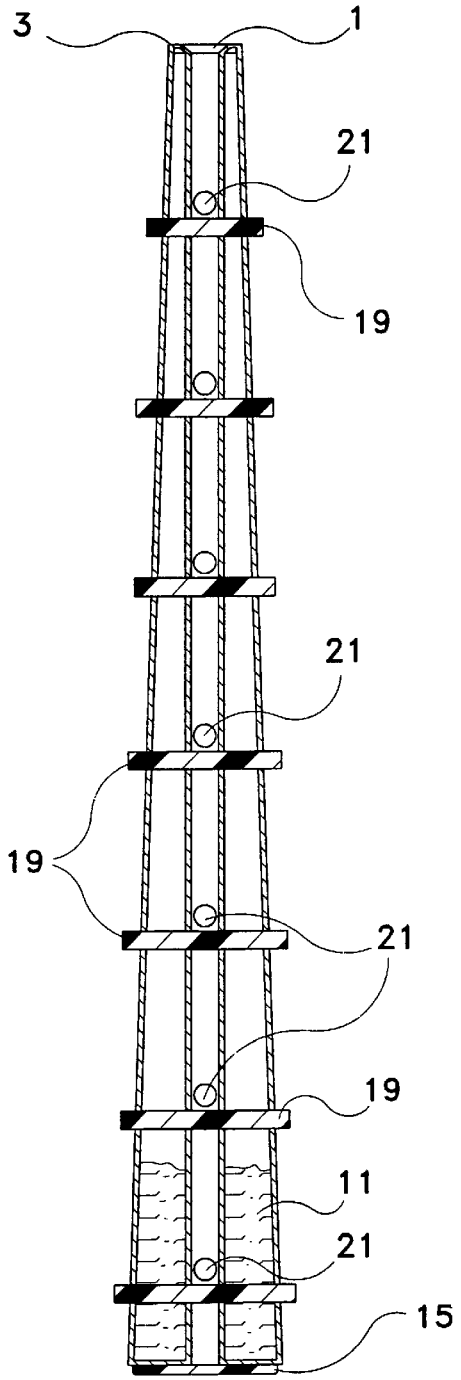
FIG. 3 is a cross sectional view of the invention taken along line A—A of FIG. 2 showing the interior inner post and supporting tubular members.

FIG. 3 is a cross sectional view of the invention taken along line A—A of FIG. 2 looking along the heights of the poles 1 and 3 and showing the interior inner post and supporting sets of tubular members 5. In this view only the bottom cap member 15 is shown with the top cap 13 having been removed as in FIG. 2. Each supporting member 19 and 21 engage both the inner pole 1 and the outer pole 3 to provide for a very stable set up between the two poles.

The present invention would provide all of the benefits of current wooden and concrete fence and utility poles, including strength and durability. In addition, this type of pole would be easier to repair in the event of major destructive forces. When used in place of light posts and utility poles, the present invention would reduce injuries to drivers and passengers in vehicles when they collide as well as reducing damage to the vehicle.

Depending on the particular use selected for the present invention, it can be tailored to the needs of the user. Different sizes with different types of fill material can be used. Lamp posts, fence posts, utility poles are just a small listing of the types of poles or posts that employ the principles of this present invention.

Although the preferred embodiment of the present invention and the method of using the same has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A pole assembly comprising:

an inner pole having a height extending in an upright direction:

an outer pole with a height, said outer pole having a larger cross sectional dimension than said inner pole, and said outer pole extending around and along the height of the inner pole; and lateral supporting members extending from and joined to said inner pole and to said outer pole, said lateral supporting members having at least two cross members, both of which engage the inner pole and the outer pole, and wherein there is a space between said inner pole and said outer pole along the heights of said inner and outer poles, and a fill material is deposited in said space, and wherein said lateral supporting members consists of a series of spaced sets of two members with each set having two generally perpendicular members, and wherein there are at least four sets of lateral supporting members with each individual supporting member being of a tubular configuration, and wherein at least one of said tubular configurated lateral supporting members is made of a hollow material.

2. The pole assembly as claimed in claim 1, wherein said outer pole has a top and bottom, and said outer pole is tapered from said bottom to said top with closing end caps for the bottom and top.

* * * * *